US009153883B2

(12) United States Patent
Ohnuma

(10) Patent No.: US 9,153,883 B2
(45) Date of Patent: Oct. 6, 2015

(54) TERMINAL

(75) Inventor: Kentaro Ohnuma, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/236,267

(22) PCT Filed: Jul. 31, 2012

(86) PCT No.: PCT/JP2012/004850

§ 371 (c)(1),
(2), (4) Date: Jan. 30, 2014

(87) PCT Pub. No.: WO2013/018352

PCT Pub. Date: Feb. 7, 2013

(65) Prior Publication Data

US 2014/0162505 A1 Jun. 12, 2014

(30) Foreign Application Priority Data

Aug. 2, 2011 (JP) ..... 2011-169460

(51) Int. Cl.

| | |
|---|---|
| ***H01R 13/03*** | (2006.01) |
| ***H01R 43/16*** | (2006.01) |
| ***H01R 4/62*** | (2006.01) |
| *H01R 4/18* | (2006.01) |

(52) U.S. Cl.

CPC ..... *H01R 4/62* (2013.01); *H01R 13/03* (2013.01); *H01R 4/184* (2013.01)

(58) Field of Classification Search

CPC ..... H01R 13/03; H01R 43/16; H01R 23/7073
See application file for complete search history.

(56) References Cited

U.S. PATENT DOCUMENTS

| | | | | |
|---|---|---|---|---|
| 5,075,176 | A * | 12/1991 | Brinkmann | 428/647 |
| 5,281,176 | A * | 1/1994 | Yahagi et al. | 439/887 |
| 5,916,695 | A * | 6/1999 | Fister et al. | 428/647 |
| 6,215,670 | B1 * | 4/2001 | Khandros | 361/774 |
| 8,101,285 | B2 * | 1/2012 | Mitose et al. | 428/607 |
| 2002/0117330 | A1 * | 8/2002 | Eldridge et al. | 174/260 |
| 2003/0077952 | A1 * | 4/2003 | Steenkiste et al. | 439/886 |
| 2003/0173107 | A1 * | 9/2003 | Smith et al. | 174/256 |
| 2006/0057905 | A1 * | 3/2006 | McGill et al. | 439/886 |
| 2010/0041284 | A1 * | 2/2010 | Beck et al. | 439/886 |

(Continued)

FOREIGN PATENT DOCUMENTS

| | | | |
|---|---|---|---|
| CN | 1591979 | A | 3/2005 |
| CN | 101635394 | A | 1/2010 |

(Continued)

OTHER PUBLICATIONS

International Search Report of PCT/JP2012/004850, dated Nov. 19, 2012.

(Continued)

*Primary Examiner* — Gary Paumen
(74) *Attorney, Agent, or Firm* — Sughrue Mion, PLLC

(57) ABSTRACT

Provided is a terminal, including: a ground metal part made of a first metallic material; an intermediate layer made of a second metallic material having a smaller value of standard electrode potential than that of the first metallic material, and plated thin on at least a part of a surface of the ground metal part; and a surface layer made of a third metallic material having a smaller value of standard electrode potential than that of the second metallic material, and plated thin on at least a part of a surface of the intermediate layer.

4 Claims, 2 Drawing Sheets

(56) References Cited

U.S. PATENT DOCUMENTS

| | | | | |
|---|---|---|---|---|
| 2011/0014825 | A1 | 1/2011 | Drew et al. | |
| 2012/0058692 | A1 * | 3/2012 | Huang et al. | 439/886 |

FOREIGN PATENT DOCUMENTS

| | | | |
|---|---|---|---|
| JP | 2005-276792 | A | 10/2005 |
| JP | 2009283287 | A | 12/2009 |
| WO | 2009/142277 | A1 | 11/2009 |

OTHER PUBLICATIONS

Communication dated Apr. 14, 2015 from the Japanese Patent Office in counterpart application No. 2011-169460.

Communication dated Jun. 23, 2015, issued by the Japan Patent Office in corresponding Japanese Application No. 2011-169460.

Communication dated Jun. 30, 2015, issued by the State Intellectual Property Office of the People's Republic of China in corresponding Chinese Application No. 201280038712.1.

* cited by examiner

TERMINAL

CROSS REFERENCE TO RELATED APPLICATIONS

This application is a National Stage of International Application No. PCT/JP2012/004850 filed Jul. 31, 2012, claiming priority based on Japanese Patent Application No. 2011-169460, filed Aug. 2, 2011, the contents of all of which are incorporated herein by reference in their entirety.

TECHNICAL FIELD

The present invention relates to a terminal, and particularly, to a terminal which is installed at an end part of a cable.

BACKGROUND ART

Conventionally, at an end part of an electric wire (cable) made of copper or an alloy thereof, a crimp terminal made of copper or an alloy thereof is provided, and the crimp terminal is connected to a terminal of another equipment to connect the electric wire to the another equipment.

Further, in order to achieve a more lightweight electric wire, or some other purpose, the electric wire may be made of aluminum or an alloy thereof instead of copper or an alloy thereof. As a document related to the conventional technique, Patent literature 1 can be referenced, for example.

CITATION LIST

Patent Literature

[PTL 1]

Japanese Patent Application Laid-Open Publication No. 2005-276792

SUMMARY OF INVENTION

Technical Problem

By the way, in the case where the electric wire (conductor) is made of aluminum or an alloy thereof, and the crimp terminal is made of copper or an alloy thereof, water, if has got into the crimping part (the part where the crimp terminal is engaged with the electric wire), may cause galvanic corrosion due to the difference in potential between the dissimilar metals. And, there is the possibility that, in addition to the corrosion of the electric wire, an increase in electric resistance and a decrease in anchoring force (bonding force between the crimp terminal and the electric wire) may be caused in the crimping part, which presents a problem.

The present invention has been made in view of the aforementioned problem, and is intended to provide a terminal installed on a conductor, which can prevent corrosion of the conductor, avoiding an increase in electric resistance in the crimping part, and avoiding a decrease in anchoring force in the crimping part.

Solution to Problem

According to an aspect of the present invention, there is provided a terminal including: a ground metal part which is made of a first metallic material; an intermediate layer which is made of a second metallic material having a lower standard electrode potential than that of the first metallic material, and which is plated thin on at least a part of a surface of the ground metal part; and a surface layer which is made of a third metallic material having a lower standard electrode potential than that of the second metallic material, and which is plated thin on at least a part of a surface of the intermediate layer.

According to an aspect of the present invention, the terminal is a crimp terminal to be used at an end part of a conductor, being installed on the conductor, and the intermediate layer and the surface layer are provided in a portion where the terminal is to be contacted with the conductor.

According to an aspect of the present invention, the first metallic material is copper or an alloy thereof; the second metallic material is iron or an alloy thereof, lead or an alloy thereof, tin or an alloy thereof, nickel or an alloy thereof, or zinc or an alloy thereof; and the third metallic material is aluminum or an alloy thereof.

Advantageous Effects of Invention

According to aspects of the present invention, there are provided advantageous effects that, with the terminal installed on a conductor, it is possible to prevent corrosion of the conductor, avoid an increase in electric resistance in the crimping part, and avoid a decrease in anchoring force in the crimping part.

DESCRIPTION OF EMBODIMENTS

Figure 1:
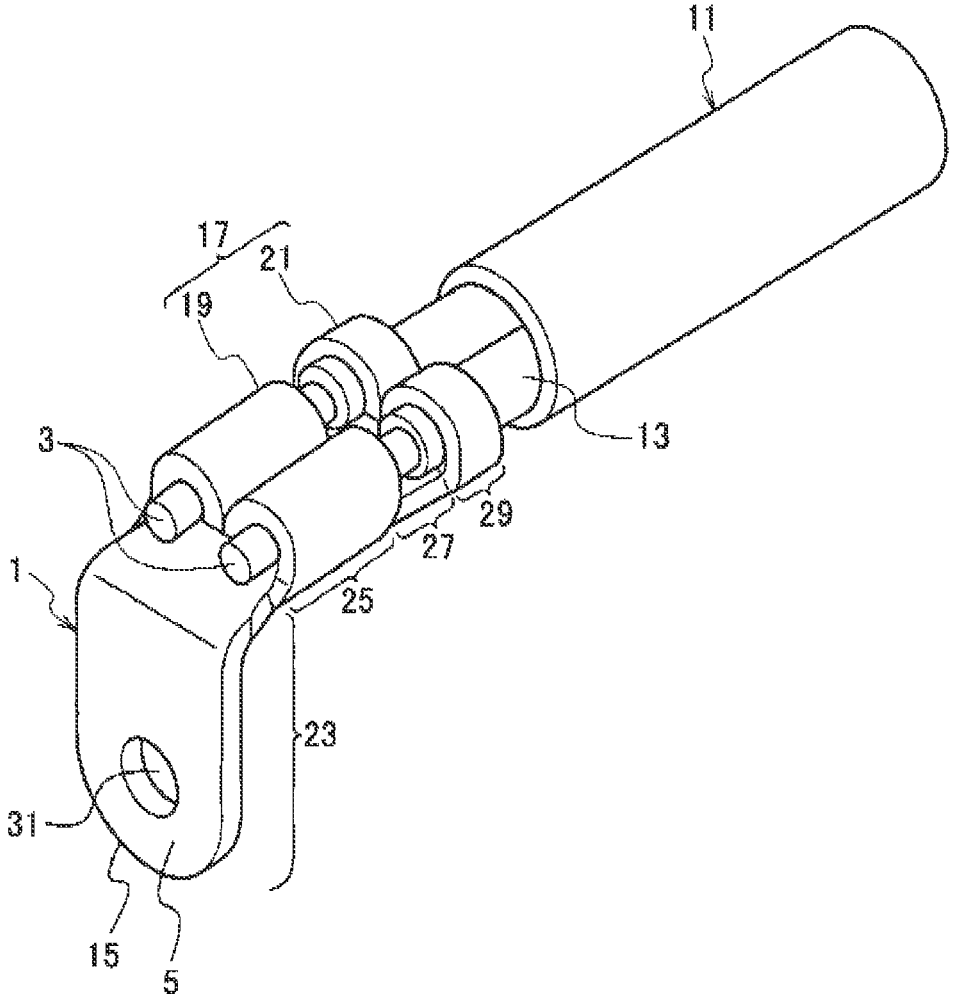
FIG. 1 is a perspective view illustrating the state in which a crimp terminal according to an embodiment of the present invention is installed on a cable.

A terminal 1 (for example, a crimp terminal which is used, being installed integrally with an electric wire 3 at an end part of the electric wire 3) according to an embodiment of the present invention includes a ground metal part 5, an intermediate layer 7 and a surface layer 9. The intermediate layer 7 and the intermediate layer 9 are provided by double plating them on the ground metal part 5.

The ground metal part 5 is made of a first metallic material (such as copper or an alloy thereof). The intermediate layer 7 is made of a second metallic material (a material which can be directly plated on the ground metal part 5, such as iron or an alloy thereof).

As a second metallic material, a material which has a lower standard electrode potential than that of the first metallic material, such as any of lead or an alloy thereof, or, tin or an alloy thereof, or, nickel or an alloy thereof, or, zinc or an alloy thereof, may be adopted.

The intermediate layer 7 is provided by plating it thin on at least a part of a surface of the ground metal part 5. The surface layer 9 is made of a third metallic material (such as aluminum or an alloy thereof).

The third metallic material may be made of, instead of aluminum or an alloy thereof, a material which has a lower standard electrode potential than that of the second metallic material (a material which cannot be directly plated on the ground metal part 5, but can be directly plated on the intermediate layer 7). The surface layer 9 is provided by plating it thin on at least a part of a surface of the intermediate layer 7.

When the crimp terminal 1 is installed on the electric wire (conductor) 3, the surface layer 9 is contacted with the electric wire 3 made of a fourth metallic material (such as aluminum or an alloy thereof). The standard electrode potential of the third metallic material and the standard electrode potential of the fourth metallic material are equal to each other, or slightly different from each other to such a degree that galvanic corrosion will not be caused.

In addition, in the crimp terminal 1, the intermediate layer 7 and the surface layer 9 are provided in, for example, a portion (a conductor crimping part) 19 where the crimp terminal 1 is contacted with the electric wire 3, or in the conductor crimping part 19 and the vicinity thereof.

More particularly, the crimp terminal 1 is used, being installed on the cable 11. The cable 11 includes an electric wire (an electric wire made of, for example, aluminum or an alloy thereof) 3 and a sheath 13 covering this electric wire 3 (a sheath made of a material, such as a synthetic resin having electrical insulation), and in the end part of the cable 11 where the crimp terminal 1 is installed, the sheath 13 is removed over a predetermined length, the electric wire 3 being exposed.

The crimp terminal 1 includes an electrode connecting part 15 and a cable crimping part 17. The electrode connecting part 15 is a portion for connecting with a terminal (not shown) of another equipment. The cable crimping part 17 is a portion for engaging with the cable 11. The cable crimping part 17 includes a conductor crimping part (an electric wire crimping part; a terminal crimping part) 19 and a sheath crimping part 21. The conductor crimping part 19 is a portion where the crimp terminal 1, when installed on the cable 11, is engaged with the electric wire 3 which is exposed at an end part of the cable 11, and the sheath crimping part 21 is a portion where the crimp terminal 1, when installed on the cable 11, is engaged with the sheath 13 of the cable 11 in the vicinity of the electric wire 3, which is exposed.

The ground metal part 5 of the crimp terminal 1 is produced by working (for example, blanking) a flat plate-like blank to a predetermined geometry, and then bending at the boundary between the electrode connecting part 15 and the cable crimping part 17 at, for example, 90-degree angle.

In the state in which the flat plate-like blank having been worked to a predetermined geometry, it has a geometry including a portion (a first portion) 23 which has a predetermined width, one end part thereof being semi-circular; a second portion 25 which is connected to the first portion 23 on the side of the other end part of the first portion 23; a third portion 27 which is connected to the second portion 25 on the side of the other end part (the side opposite to the first portion 23) of the second portion 25; and a fourth portion 29 which is connected to the third portion 27 on the side of the other end part (the side opposite to the second portion 25) of the third portion 27. The width of the first portion 23 and the width of the third portion 27 are, for example, equal to each other. The width of the second portion 25 is wider than the width of the first portion 23. The width of the fourth portion 29 is equal to the width of the second portion 25, or wider than the width of the second portion 25.

The 90-degree angle bending of the ground metal part 5 of the crimp terminal 1 is made in an area of the first portion 23 in the vicinity of the second portion 25. Therefore, a part of the first portion 23 which is located on the side opposite to the second portion 25 with respect to the 90-degree angle bending line, constitutes the electrode connecting part 15. In addition, the second portion 25 constitutes the conductor crimping part 19, while the fourth portion 29 constitutes the sheath crimping part 21.

In the electrode connecting part 15, there is provided a through-hole 31, which is used when the crimp terminal 1 is connected to a terminal of another equipment.

In the conductor crimping part 19, a concave part 33 is formed which is provided for preventing displacement of the electric wire 3 when the conductor crimping part 19 is engaged with the electric wire 3.

Figure 2:
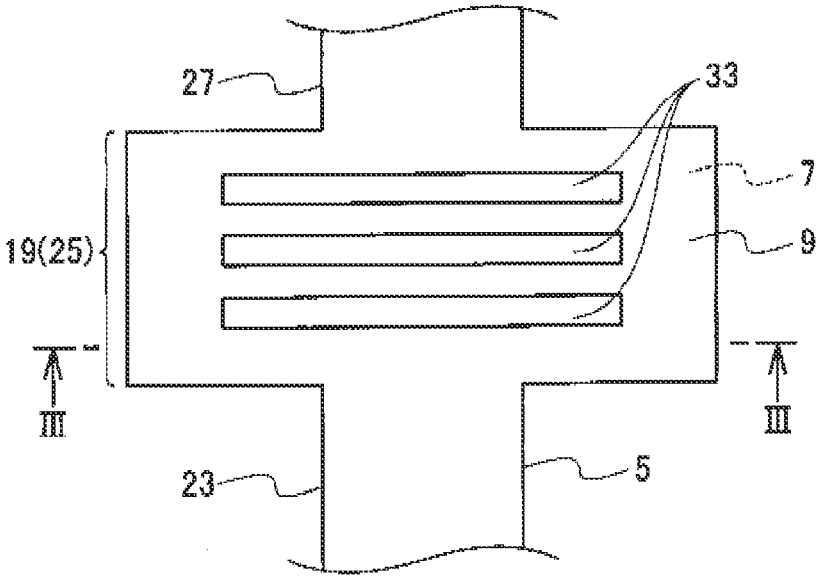
FIG. 2 is a plan view illustrating a conductor crimping part of the crimp terminal and a portion in the vicinity thereof.
Figure 3:
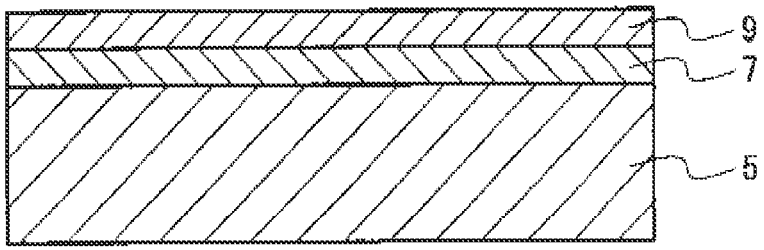
FIG. 3 is a section view taken on line III-III in FIG. 2.

After the ground metal part 5 having been formed, the intermediate layer 7 is provided by plating. The intermediate layer 7 is provided, for example, only in the second portion 25 (including the concave part 33) in the shape of a rectangle, or only in the second portion 25, a part of the first portion 23 in the vicinity of the second portion 25, and a part of the third portion 27. Further, the intermediate layer 7 is provided only on one surface perpendicular to the direction of thickness of the second portion 25, or the like, (a surface on the side opposite to the surface on the side where the electrode connecting part 15 extends, being bent; a surface appearing in FIG. 2).

The concave part 33 is formed in the shape of a long and slender rectangular parallelepiped. Thereby, in the opening part of the concave part 33, the angle of the wall part of the conductor crimping part 19 is 90-degree angle, however, in the opening part of the concave part 33, the angle of the wall part of the conductor crimping part 19 may be an obtuse angle. In other words, the geometry of the concave part 33 may be of a truncated quadrangular pyramid. In the case where the geometry of the concave part 33 is of a truncated quadrangular pyramid, the opening part in the shape of a rectangular parallelepiped of the concave part 33 shall be larger than the bottom part in the shape of a rectangular parallelepiped of the concave part 33.

After the intermediate layer 7 having been provided, the surface layer 9 is provided by plating it only on the surface of the intermediate layer 7.

For installing the crimp terminal 1 thus produced on the cable 11, the electric wire 3, which is exposed in the end part of the cable 11, is disposed in the area of the conductor crimping part 19 (disposed such that the surface layer 9 is contacted with the electric wire 3), and the sheath 13 located in the vicinity of the conductor 3 exposed is disposed in the area of the sheath crimping part 21. And, a pair of the conductor crimping parts 19 is caulked in the shape of a pair of cylinders, and a pair of the sheath crimping parts 21 is caulked in the shape of a pair of cylinders, thereby the crimp terminal 1 being integrally installed on the cable 11. As a result of this, the cable is extended on the side opposite to the electrode connecting part 15.

In the state in which the crimp terminal 1 has been installed on the cable 11, the electric wire 3 is contacted only with the surface layer 9 of the crimp terminal 1, and the electric wire 3 is not directly contacted with the ground metal part 5.

According to the crimp terminal 1, when it is installed on the cable 11, the electric wire 3 made of aluminum or an alloy thereof and the ground metal part 5 of the crimp terminal 1 made of copper or an alloy thereof will not be directly contacted with each other, and the crimp terminal 1 is engaged with (electrically connected to) the electric wire 3 of the cable 11 through the intermediate layer 7 and the surface layer 9, whereby corrosion of the electric wire 3 can be prevented, with an increase in electric resistance in the conductor crimping part 19 being avoided, and a decrease in anchoring force in the conductor crimping part 19 being avoided.

In other words, when the crimp terminal 1 has been installed on the cable 11, the surface layer 9, which is provided in the conductor crimping part 19 of the crimp terminal 1, is contacted with the electric wire 3 of the cable 11, but, the surface layer 9 of the conductor crimping part 19 of the crimp terminal 1 is made of aluminum or an alloy thereof, and the electric wire 3 is also made of aluminum or an alloy thereof, thereby there being practically no difference in potential between the conductor crimping part 19 of the crimp terminal 1 and the surface layer 9 of the cable 11. Therefore, if, after the crimp terminal 1 having been installed on the cable 11, water, if has got into such an area as the conductor crimping part 19 of the crimp terminal 1, or the like, galvanic corrosion will not be caused, which allows corrosion of the electric wire 3 to be prevented, an increase in electric resistance in the conductor crimping part 19 to be avoided, and a decrease in anchoring force in the conductor crimping part 19 to be avoided.

In addition, it is impossible to directly provide a layer of aluminum or an alloy thereof for the ground metal part 5 of the crimp terminal 1 by plating, since the difference in standard electrode potential between aluminum or an alloy thereof and copper or an alloy thereof is too great. However, using iron or an alloy thereof as an intermediate layer 7 has made it possible to provide the ground metal part 5 with the surface layer 9 of the crimp terminal 1 made of aluminum or an alloy thereof.

In addition, in the case where the electric wire 3 of the cable 11 is made of aluminum or an alloy thereof, it may be conceived that, in order to prevent galvanic corrosion from being caused, the whole of the crimp terminal 1 is made of aluminum or an alloy thereof. However, if the whole of the crimp terminal 1 is made of aluminum, or the like, the toughness or modulus of elasticity of the crimp terminal 1 will be lowered, thereby holding the end part of the cable 11 with the crimp terminal 1 being made difficult. In other words, a sufficient contact load (a sufficient force of holding the cable 11) may not be secured in the spring contact point part of the conductor crimping part 19 or the sheath crimping part 21 of the crimp terminal 1.

However, if the ground metal part 5 of the crimp terminal 1 is made of copper or an alloy thereof, the toughness or modulus of elasticity is increased, and whereby the cable 11 can be reliably held with the crimp terminal 1.

By the way, with the crimp terminal 1, as can be seen from the above description, the value of the standard electrode potential of the first metallic material constituting the ground metal part 5 is, for example, positive with respect to the value of the potential of the hydrogen electrode (0 volts).

The value of the standard electrode potential of the second metallic material constituting the intermediate layer 7 is, for example, negative with respect to the value of the potential of the hydrogen electrode. The absolute value of the standard electrode potential of the second metallic material is a value of 30% to 250%, or so, with respect to the absolute value of the standard electrode potential of the first metallic material.

In addition, the value of the standard electrode potential of the third metallic material constituting the surface layer 9 is further smaller than the value of the standard electrode potential of the second metallic material. Further, the absolute value of the standard electrode potential of the third metallic material is a value of 400% to 700%, or so, with respect to the absolute value of the standard electrode potential of the first metallic material.

In the above explanation, the crimp terminal 1 is provided with the intermediate layer 7 and the surface layer 9, but, instead of or in addition to providing the crimp terminal 1 with the intermediate layer 7 and the surface layer 9, the electric wire 3 of the cable 11 may be provided with the intermediate layer 7 and the surface layer 9. And, when the crimp terminal 1 is installed on the cable 11, the portion of the electric wire 3 of the cable 11 that is provided with the intermediate layer 7 and the surface layer 9 may be contacted with the conductor crimping part 19 of the crimp terminal 1.

REFERENCE SIGNS LIST

1 crimp terminal (terminal)
3 electric wire (conductor)
5 ground metal part
7 intermediate layer
9 surface layer
19 conductor crimping part (conductor contacting portion)

The invention claimed is:

1. A terminal comprising:

a ground metal part which is made of a first metallic material;

an intermediate layer which is made of a second metallic material having a lower standard electrode potential than that of the first metallic material, and which is plated thin on at least a part of a surface of the ground metal part; and a surface layer which is made of a third metallic material having a lower standard electrode potential than that of the second metallic material, and which is plated thin on at least a part of a surface of the intermediate layer; wherein the second metallic material is zinc or an alloy consisting essentially of zinc.

2. The terminal of claim 1, wherein the terminal is a crimp terminal to be used at an end part of a conductor, being installed on the conductor, and the intermediate layer and the surface layer are provided in a portion where the terminal is to be contacted with the conductor.

3. The terminal of claim 1, wherein the first metallic material is copper or an alloy thereof;

the third metallic material is aluminum or an alloy thereof.

4. The terminal of claim 2, wherein the first metallic material is copper or an alloy thereof;

the third metallic material is aluminum or an alloy thereof.

* * * * *